United States Patent [19]

Leuchter

[11] 4,096,507

[45] Jun. 20, 1978

[54] CONTINUOUSLY OPERATING DEVELOPING MACHINE WITH MEANS FOR REMOVING BLEACHING FLUID VAPORS

[75] Inventor: Jürgen Leuchter, Tutzing, Germany

[73] Assignee: AGFA-Gevaert AG, Leverkusen, Germany

[21] Appl. No.: 697,572

[22] Filed: Jun. 18, 1976

[30] Foreign Application Priority Data

Jun. 28, 1975 Germany ..... 2529008

[51] Int. Cl.[2] ..... G03D 17/00

[52] U.S. Cl. ..... 354/307; 354/300; 354/312; 55/70

[58] Field of Search ..... 354/300, 307, 324, 319, 354/320, 321, 322, 312; 55/70, 68, 309, 468; 34/72

[56] References Cited

U.S. PATENT DOCUMENTS

| | | | |
|---|---|---|---|
| 3,836,987 | 9/1974 | Gibbons et al. | 354/300 |
| 3,900,862 | 8/1975 | Bennett et al. | 354/300 |
| 3,915,708 | 10/1975 | Zausmer | 354/300 |
| 3,982,258 | 9/1976 | Czebiniak | 354/300 |
| 4,003,069 | 1/1977 | Hilgers | 354/300 |

*Primary Examiner*—L. T. Hix
*Assistant Examiner*—Alan Mathews
*Attorney, Agent, or Firm*—Michael J. Striker

[57] ABSTRACT

The developing machine includes a plurality of processing stages including a bleaching stage comprised of a bath of bleaching fluid. Processing fluid is supplied to at least some of the processing stages. A device powered by the flow of processing fluid to one of the processing stages sucks out from the interior of the bleaching stage the vapors arising from the bath of bleaching fluid therein. In the illustrated embodiment, the sucking device is a water-jet pump powered by the flow of washing water to the washing stage of the developing machine.

9 Claims, 3 Drawing Figures

CONTINUOUSLY OPERATING DEVELOPING MACHINE WITH MEANS FOR REMOVING BLEACHING FLUID VAPORS

BACKGROUND OF THE INVENTION

The invention relates to a continuously operating developing machine of the type in which film to be developed travels through a plurality of processing stages, such as processing stages comprised of containers for baths of developing fluid, bleaching fluid, fixing fluid, washing water and stabilizing fluid.

In many developing machines of the general type in question, it has become customary to arrange a bleaching fluid bath downstream of the developing fluid bath. However, it has been found that the vapors arising from the bleaching fluid bath, which are the most chemically aggressive of the vapors arising from the processing fluid baths, can spread into other processing stages of the developing machine. Usually, the chemicals employed in the development of film in these machines are such that the vapors in question are ammonia vapors. These vapors do not pose too great a threat to the processing stage located downstream of the bleaching stage; however, these vapors pose a substantial threat to the developing stage located upstream of the bleaching stage. The entrance of ammonia vapors into the developing fluid bath can result in a purple-colored coating covering the film developed by the machine.

To avoid this difficulty, it is known to employ a venting apparatus operative for sucking ammonia vapors out of the space in the bleaching stage located above the bleaching fluid bath. This expedient is disadvantageous. In the first place, a separate source of energy must be employed to drive the venting apparatus. Additionally, metallic parts of the venting apparatus can become corroded in an extremely short time as a result of contact by the corrosive ammonia vapors, so that frequent replacement of such parts is necessary.

SUMMARY OF THE INVENTION

It is a general object of the invention to provide a continuously operating developing machine with means simpler than heretofore used for sucking off bleaching fluid vapors, the means being less susceptible to chemical attack or mechanical failure, more reliable in operation, and less consumptive of energy than heretofore.

This object, and others which will become more understandable from the description of preferred embodiments, can be met according to one advantageous concept of the invention, by sucking bleaching fluid vapor out of the bleaching fluid stage utilizing a sucking device which is powered by the flow of processing fluid to or from one of the processing stages.

Advantageously, the sucking device is powered by the flow of washing water to the washing stage of the developing machine.

According to a particularly advantageous concept of the invention, the sucking device is comprised of a water-jet pump through which the washing stage receives its supply of washing water. The suction port of the water-jet pump communicates directly or indirectly with the space above the bleaching fluid bath. As washing water flows through the water-jet pump to the washing stage, the suction which developes is utilized to suck the bleaching fluid vapor out of the bleaching fluid stage.

The inventive expedient is advantageous in a number of respects. The utilization of the continual supply of washing water to the washing stage or stages makes unnecessary the use of a separate drive for powering the means which is to carry off the bleaching fluid vapors. The volumetric flow rate of washing water, usually on the order of 3 liters per minute, is sufficient to generate a suction force strong enough to suck off the bleaching fluid vapors. The use of a water-jet pump is particularly advantageous because it need not include any moving parts, making it particularly simple to make the water-jet pump of a material which is insensitive to the chemically aggressive bleaching fluid vapors.

According to a further advantageous concept of the invention, a small connector is arranged between the developing stage and the bleaching stage, with the film to be developed travelling from the one stage to the other through the small connector. The bleaching fluid vapor is sucked out through this small connector, with the result that penetration of the bleaching fluid vapor into the developing stage is prevented with a high degree of completeness and reliability. This is because the space being vented is a small space in direct communication with the developing stage; this is in contrast to the alternative expedient of venting the larger space within the bleaching stage itself.

The novel features which are considered as characteristics for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
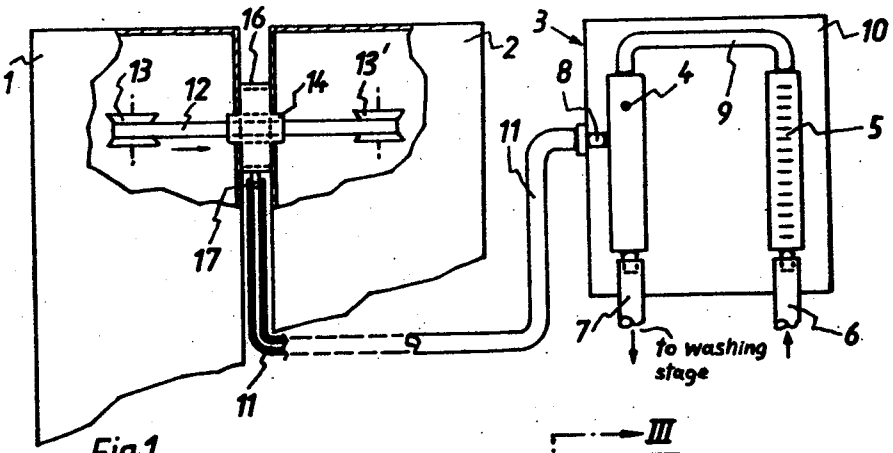
FIG. 1 is a schematic representation of the arrangement of components of a developing machine according to the invention.

FIG. 1 is a top view looking down upon a developing fluid container 1 and a bleaching fluid container 2, these being partially broken away for viewability. A sucking apparatus 3 is essentially comprised of a water-jet pump 4, a flowmeter 5, a water inlet conduit 6, a water outlet conduit 7, a suction port 8 and a connecting conduit 9. The water inlet conduit 6 is connected to the flowmeter 5. The other end of the flowmeter 5 is connected via the connecting conduit 9 to the inlet of the water-jet pump 4, and the outlet of the latter is connected to the outlet conduit 7 leading into a washing stage of the developing machine. Advantageously, the water-jet pump 4 and the flowmeter 5 are secured to a common mounting plate 10. The suction port of the water-jet pump 4 is connected to one end of a suction conduit 11 the other end of which pneumatically communicates with the interior of the bleaching fluid container 2. The suction conduit 11 can be made to communicate directly with the part of the interior of the bleaching fluid container 2 located above the bleaching fluid bath therein.

However, it is more advantageous to have the suction conduit 11 communicate directly with the space via which the containers 1 and 2 communicate with each other. As shown in FIG. 1, film 12 leaves the developing fluid container 1 via an outlet roller 13, travels through a connector 14 arranged intermediate the containers 1 and 2, and then enters via an inlet roller 13' into the bleaching fluid container 2. Because the developing machine of the illustrated embodiment is a daylight developing machine, the connector 14 must assure that the film travelling therethrough does not become exposed to light during its passage.

Figure 2:
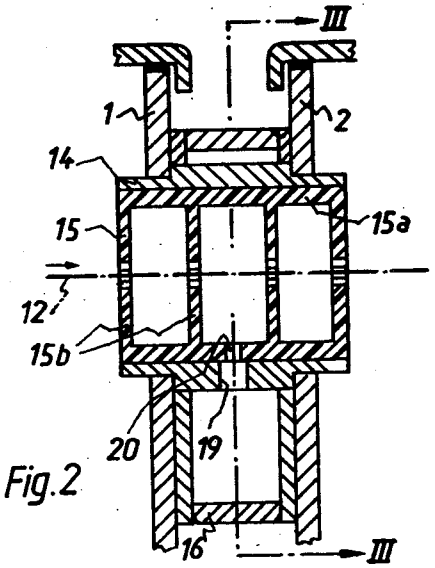
FIG. 2 is a vertical section through the connecting structure intermediate two adjoining processing fluid stages.
Figure 3:
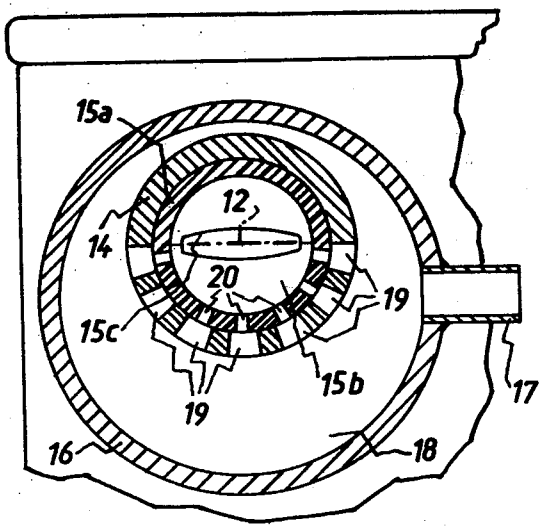
FIG. 3 is a section taken on line III—III of FIG. 2.

FIGS. 2 and 3 depict details of the construction of the connection of the containers 1 and 2 to each other. A connector 14 is arranged intermediate the walls of containers 1 and 2. The connector 14 is essentially comprised of a cylindrical sleeve with a larger-diameter central portion having an axial length exactly equal to the spacing between the walls of the adjoining containers 1 and 2. Inserted within the connector 14 is a light labyrinth structure 15 comprised of a cylindrical sleeve **15*a* and radially inward extending sections 15*b*. The sections 15*b* leave free narrow ellipse-shaped cut-outs 15*c* through which the film 12 is transported from the container 1 to the container 2. Advantageously, the container 14** is made of synthetic plastic or rubber.

Connector 14 is surrounded intermediate the two containers by a synthetic plastic housing 16 provided with a connecting nipple 17. Housing 16 is of cylindrical shape but of a diameter greater than that of the connector 14, preferably twice as great. The housing 16 is disposed eccentrically relative to the connector 14, so as to form an underpressure chamber 18 inside the housing 16. The sides of the light labyrinth structure 15 and of the connector 14 facing toward the eccentric underpressure chamber 18 are provided with apertures 20 and 19, respectively, establishing communication between the interior of the light labyrinth structure 15 and the underpressure chamber 18.

The illustrated embodiment operates as follows:

During the developing of the film 12, the film is transported from the container 1 to the container 2 through the ellipse-shaped cut-outs **15*c* of the light labyrinth structure 15. Water is supplied to a washing container through the water inlet 6, the flowmeter 5 and the water-jet pump 4. There developes within the water-jet pump 4 a suction force, as a result of which an underpressure is established in the chamber 18, which communicates with water-jet pump 4 through the intermediary of the suction conduit 11 and the connecting nipple 17. The vapors forming above the bleaching fluid in the bleaching fluid container 2 in part spread through the cut-outs 15*c* into the interior of the light labyrinth structure 15. Due to the underpressure in chamber 18, these vapors are drawn out through apertures 20 in the cylindrical sleeve 15*a* of the light labyrinth structure 15 and through apertures 19 in the cylindrical sleeve of the connector 14; in this way, such vapors are prevented from penetrating into the interior of the developing fluid container 1. Instead, these vapors are drawn into the interior of the washing container, where they can no longer do any harm to the developed film therein. The bleaching fluid vapors accumulating in the washing container above the washing water therein can be sucked out by the venting arrangement provided in the (non-illustrated) drying stages of the developing machine. Chemical damage to the material of such venting arrangement is not to be expected. The light labyrinth structure 15 assures, inter alia, that if one of the two containers 1 and 2** is opened light will not penetrate into the other.

It will be understood that each of the elements described above, or two or more together, may also find a useful application in other types of constructions differing from the types described above.

While the invention has been illustrated and described as embodied in a daylight developing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a film-developing machine of the daylight type comprised of a plurality of processing stages, including a bleaching stage comprised of a bath of bleaching fluid and a washing stage, arranged one after the other in the direction of film transport through the processing stages, and means for supplying washing water to the washing stage, said means including a water supply conduit, in combination therewith, sucking means powered by flow of water through the water supply conduit and operative for sucking out of the bleaching stage vapors forming in the bleaching stage, the sucking means including a water-jet pump connected in the water supply conduit and having a suction port at which develops a suction pumping force when water is transmitted through the water supply conduit and through the water-jet pump, and means pneumatically connecting the suction port of the water-jet pump to the interior of the bleaching stage and operative for transmitting said suction pumping force to the space above the bleaching fluid in the bleaching stage, whereby to cause vapors developing in the bleaching stage to be drawn off into the suction port of the water-jet pump.

2. The developing machine of claim 1, at least the interior of the water-jet pump being made of a material which does not corrode in response to contact by vapors developing in the bleaching stage.

3. The developing machine of claim 1, the processing stages including a developing stage arranged upstream of the bleaching stage as considered in the direction of film transport, the means connecting the suction port of the water-jet pump to the interior of the bleaching stage including a connector arranged intermediate the developing stage and the bleaching stage having an interior through which the film being developed passes in travelling from the developing stage to the bleaching stage, the suction port of the water-jet pump communicating with the interior of the connector.

4. The developing machine of claim 3, the means connecting the suction port of the water-jet pump to the interior of the bleaching stage further comprising a housing surrounding the connector and defining an interior chamber accommodating at least part of the connector, the connector being provided with apertures establishing communication between the interior of the connector and the interior chamber of the housing surrounding the connector, and a suction conduit connected at one end to the suction port of the water-jet pump and at its other end to the interior chamber of the housing.

5. The developing machine of claim 4, the means connecting the suction port of the water-jet pump to the interior of the bleaching stage further including a light labyrinth structure arranged inserted within the connector, the light labyrinth structure being comprised of blocking sections provided with openings through which film is transported during travel from the developing stage to the bleaching stage, the light labyrinth structure being provided with apertures registering with the apertures of the connector.

6. The developing machine of claim 5, the connector, the housing and the light labyrinth structure being made of material resistant to the vapors which form above the bleaching bath in the bleaching stage.

7. The developing machine of claim 6, the material being selected from the group of materials consisting of synthetic plastic and rubber.

8. In a film-developing machine comprised of a plurality of processing stages, including a bleaching stage comprised of a bath of bleaching fluid, and means for supplying processing fluid to at least one of the processing stages, in combination therewith, means operative for sucking out from the interior of the bleaching stage the vapors arising from the bath of bleaching fluid and powered by the flow of the processing fluid of said one of the processing stages.

9. The developing machine of claim 8, the means for sucking out such vapors being powered by the flow of washing water to the washing stage of the developing machine.

* * * * *